US009951733B2

(12) United States Patent
Vu et al.

(10) Patent No.: US 9,951,733 B2
(45) Date of Patent: Apr. 24, 2018

(54) PLUG-IN PUMP

(71) Applicant: Continental Automotive GmbH, Hannover (DE)

(72) Inventors: Ngoc-Tam Vu, Ludwigsburg (DE); Uwe Nigrin, Ilmenau (DE)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 158 days.

(21) Appl. No.: 14/403,649

(22) PCT Filed: Dec. 19, 2013

(86) PCT No.: PCT/EP2013/077331
§ 371 (c)(1),
(2) Date: Nov. 25, 2014

(87) PCT Pub. No.: WO2014/096162
PCT Pub. Date: Jun. 26, 2014

(65) Prior Publication Data

US 2015/0345447 A1 Dec. 3, 2015

(30) Foreign Application Priority Data

Dec. 21, 2012 (DE) ..... 10 2012 224 317

(51) Int. Cl.
*F04B 17/05* (2006.01)
*F02M 59/10* (2006.01)
(Continued)

(52) U.S. Cl.
CPC ..... *F02M 59/102* (2013.01); *F02M 59/027* (2013.01); *F02M 59/442* (2013.01);
(Continued)

(58) Field of Classification Search
CPC .... F04B 1/0421; F04B 1/0448; F04B 1/0439; F04B 1/053; F04B 9/042; F04B 17/05;
(Continued)

(56) References Cited

U.S. PATENT DOCUMENTS 4,153,076 A * 5/1979 McNeil ..... F16K 11/165 137/624.11
4,526,150 A * 7/1985 Guntert ..... F02M 59/26 123/357
(Continued)

FOREIGN PATENT DOCUMENTS

DE 102008001018 A1 * 10/2009 ..... F02M 59/102
DE 102008002195 A1 12/2009
(Continued)

OTHER PUBLICATIONS

International Search Report and Written Opinion, Application No. PCT/EP2013/077331, 15 pages, dated May 27, 2014.

*Primary Examiner* — Patrick Hamo
*Assistant Examiner* — Connor Tremarche
(74) *Attorney, Agent, or Firm* — Slayden Grubert Beard PLLC

(57) ABSTRACT

A plug-in pump includes a cylinder and a pump housing, wherein the cylinder has a cavity in which a movable piston is accommodated, wherein a first end of the piston delimits a pump chamber, and a second end of the piston is connected to a drive device for the piston. An inlet valve is arranged in the cylinder, which inlet valve connects the pump chamber to a feed line for a first fluid, and an outlet valve connects the pump chamber to an outlet. The pump housing has a cavity that forms a first chamber connected to a feed line for the first fluid, and at least one second chamber which is separated from the first chamber and which is connected to
(Continued)

a fluid system of a second fluid. The first chamber is fluidically sealed off with respect to the second chamber.

20 Claims, 2 Drawing Sheets

(51) Int. Cl.

| | |
|---|---|
| ***F04B 19/22*** | (2006.01) |
| ***F04B 53/10*** | (2006.01) |
| ***F04B 53/14*** | (2006.01) |
| ***F02M 59/02*** | (2006.01) |
| ***F04B 1/04*** | (2006.01) |
| ***F04B 1/053*** | (2006.01) |
| ***F02M 59/44*** | (2006.01) |
| ***F04B 9/04*** | (2006.01) |
| ***F04B 53/16*** | (2006.01) |
| ***F04B 53/18*** | (2006.01) |

(52) U.S. Cl.
CPC ..... *F04B 1/0421* (2013.01); *F04B 1/0439* (2013.01); *F04B 1/0448* (2013.01); *F04B 1/053* (2013.01); *F04B 9/042* (2013.01); *F04B 17/05* (2013.01); *F04B 19/22* (2013.01); *F04B 53/10* (2013.01); *F04B 53/14* (2013.01); *F04B 53/16* (2013.01); *F04B 53/18* (2013.01)

(58) Field of Classification Search
CPC ..... F04B 19/22; F04B 53/10; F04B 53/14; F04B 53/16; F04B 53/18; F02M 59/102; F02M 59/027; F02M 59/442
USPC ..... 417/221
See application file for complete search history.

(56) References Cited

U.S. PATENT DOCUMENTS 5,193,510 A * 3/1993 Straubel ..... F02M 59/30 123/501
5,967,426 A * 10/1999 McLeod ..... B05B 9/007 239/146

FOREIGN PATENT DOCUMENTS

| | | | | |
|---|---|---|---|---|
| DE | 102008042650 | A1 * | 4/2010 | ..... F02M 59/06 |
| DE | 102009000857 | A1 | 8/2010 | |
| DE | 102009001566 | A1 * | 9/2010 | ..... F02M 59/102 |
| DE | 102011007781 | A1 | 10/2012 | |
| EP | 1975402 | A1 | 10/2008 | |
| WO | 2012/083914 | A2 | 6/2012 | |
| WO | 2014/096162 | A1 | 6/2014 | |

* cited by examiner

PLUG-IN PUMP

CROSS-REFERENCE TO RELATED APPLICATIONS

This application is a U.S. National Stage Application of International Application No. PCT/EP2013/077331 filed Dec. 19, 2013, which designates the United States of America, and claims priority to DE Application No. 10 2012 224 317.8 filed Dec. 21, 2012, the contents of which are hereby incorporated by reference in their entirety.

TECHNICAL FIELD

The invention relates to a plug-in pump having a cylinder and a pump housing. The cylinder has a cavity, in which a movable piston is accommodated, wherein one end of the piston delimits a pump chamber, and the other end of the piston is connected to a drive for the piston. Also arranged in the cylinder are an inlet valve, which connects the pump chamber to a feed line for a fluid, and an outlet valve, which connects the pump chamber to an outlet. The pump housing has a cavity which is divided into a first chamber, a second chamber, which is separated from the first chamber, and a connecting region, which connects the first chamber and the second chamber, wherein different fluids flow in the two chambers.

BACKGROUND

DE 10 2009 000 857 A1 discloses a plug-in pump for a fuel injection system. The plug-in pump has a piston, which is arranged in a cavity of a cylinder head and is driven by a camshaft via a roller tappet. The piston can be moved in a linear fashion in the cavity in order to open an inlet for the fuel into a pump working chamber in a suction stroke. During a subsequent delivery stroke, the fuel is passed out of the pump working chamber through a pump outlet to another unit of the engine. At its end remote from the pump working chamber, the pump piston has a sealing element surrounding it, which seals off the piston with respect to the engine oil, said oil lubricating the camshaft, for example, in order to prevent fuel from being able to get into the engine oil and vice versa.

Conventional seals, e.g. combination seals of the kind known in the prior art, are often incapable of preventing fuel from getting into the engine oil and vice versa with sufficient reliability, and therefore it is not always possible to meet the demands made by engine designers on such pumps.

SUMMARY

One embodiment provides a plug-in pump having a cylinder and a pump housing, wherein the cylinder has a cavity, in which a movable piston is accommodated, wherein a first end of the piston delimits a pump chamber, and a second end of the piston is connected to a drive device for the piston, an inlet valve is arranged in the cylinder, which inlet valve connects the pump chamber to a feed line for a first fluid, and an outlet valve, which connects the pump chamber to an outlet, wherein the pump housing has a cavity which forms a first chamber, which is connected to a feed line for the first fluid, and at least one second chamber, which is separated from the first chamber and is connected to a fluid system of a second fluid, wherein the first chamber is fluidically sealed off with respect to the second chamber.

In a further embodiment, the second end of the piston is connected to or formed integrally with an intermediate piece, which transmits a movement of the drive device to the piston.

In a further embodiment, the intermediate piece has a first section, which projects into the first chamber, a third section, which projects into the second chamber, and a second section, which connects the first section and the third section and projects through a connecting region, formed in the cavity, between the first chamber and the second chamber.

In a further embodiment, the connecting region has the shape of a hollow cylinder, having an inside diameter which corresponds substantially to an outside diameter of the second section, and wherein the inner wall of the connecting region and/or the second section has/have a sealing element, which prevents the first and second fluid from mixing.

In a further embodiment, a spring element or spring elements is/are arranged in the first chamber and/or in the second chamber, which spring element/s move/s the piston and the intermediate piece in a direction in which the inlet valve connects the feed line to the pump chamber.

In a further embodiment, the spring element in the first chamber is supported on an underside of the cylinder head and on a spring holder, which is connected to an end of the intermediate piece which faces the second end of the piston.

In a further embodiment, the spring element in the second chamber is supported on an underside of the connecting region and on a spring holder, which is connected to an end of the intermediate piece which faces the drive device.

In a further embodiment, the first fluid is carried by the feed line and connecting lines in the pump housing into an annular passage, wherein the annular passage is formed in the connecting region between the cylinder and the housing, and at least one side wall of the annular passage is formed by an outer side of the cylinder and at least one side wall of the annular passage is formed by an outer side of the housing.

In a further embodiment, the drive device is a camshaft, wherein a cam of the camshaft preferably acts on a roller tappet, and the roller tappet converts a rotary motion of the camshaft into a linear motion of the piston.

Another embodiment provides a plug-in pump having at least one of the following features: the inlet valve is a digital inlet valve; the first fluid is a fuel and the second fluid is a lubricating oil; and the cylinder is formed from steel and the housing is formed from cast steel or sintered steel.

BRIEF DESCRIPTION OF THE DRAWINGS

Example embodiments of the invention are explained in greater detail below with reference to the drawings, in which.

DETAILED DESCRIPTION

Figure 1:
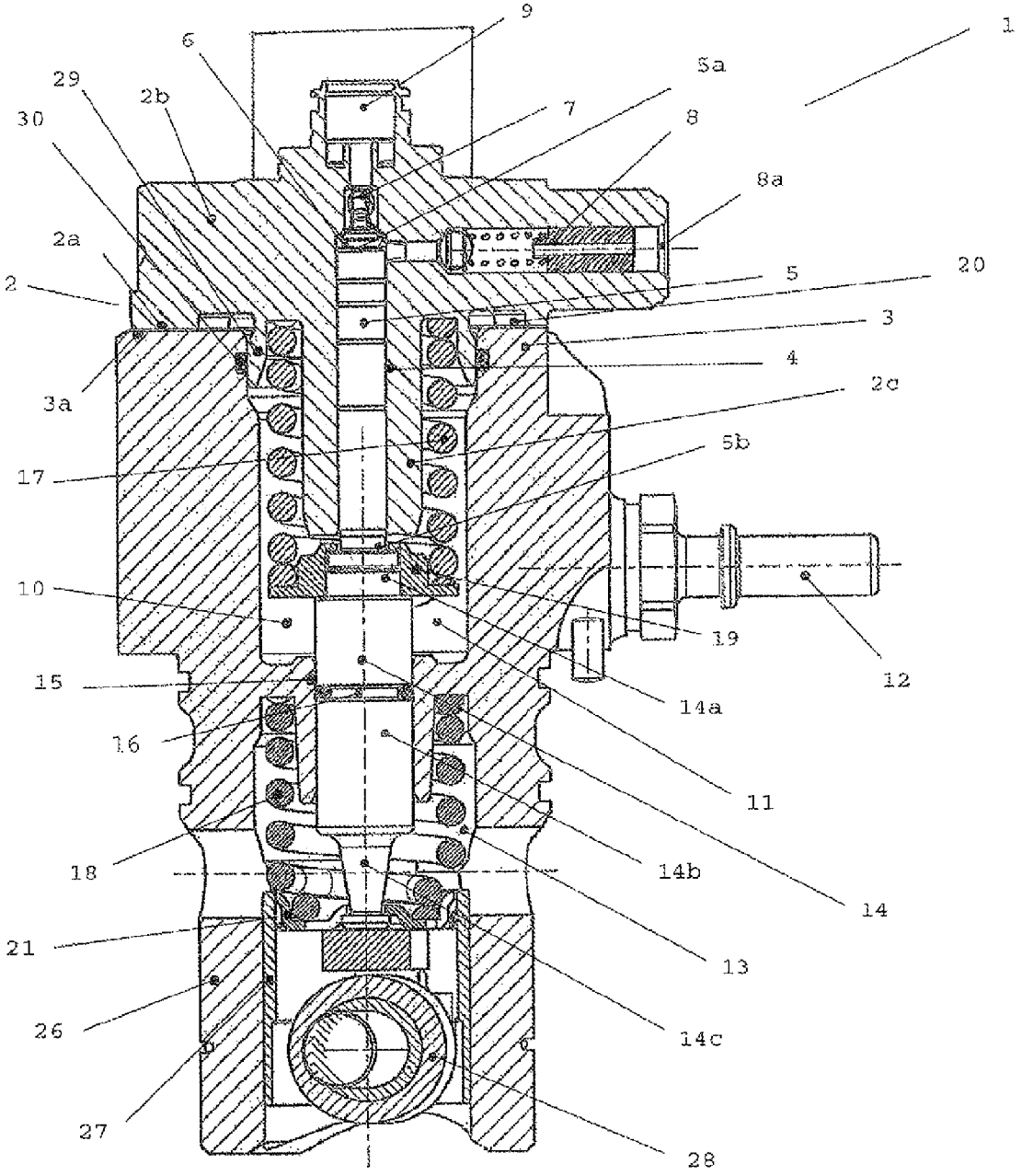
FIG. 1 shows a section through a plug-in pump according to one embodiment.

Embodiments of the invention provide a plug-in pump which, with greater reliability than hitherto known, fluidically separates a region of the pump containing a first fluid from a region interacting with the pump and containing a second fluid.

Some embodiments provide a plug-in pump having a cylinder and a separate pump housing, wherein the cylinder has a cavity, in which a movable piston is accommodated, preferably in a sealing manner. The piston can move at least in a linear fashion in the cavity, the cavity forming a guide for the piston with a shape and an inside diameter which corresponds substantially to the shape and outside diameter of the piston.

A first end of the piston, which faces the cylinder, delimits a pump chamber. That is to say that the first end completely closes the pump working chamber in a first end position, before the beginning of a suction stroke of the piston, since the first end of the piston is situated in the pump working space before the beginning of the suction stroke and fills said chamber essentially completely. After the beginning of the suction stroke, the piston moves in a direction away from the cylinder and out of the pump chamber, with the result that fuel can now flow into the pump chamber through an open inlet valve. When the suction stroke is complete, the piston is situated in a second end position, and the pump working chamber has its maximum volume. During the subsequent delivery stroke of the piston back into the first position, the inlet valve is closed and the fuel in the pump working chamber is forced out of the pump working chamber through an outlet valve.

In this case, the inlet and the outlet valve are arranged in the cylinder, and the inlet valve connects the pump working chamber to a feed line for a first fluid.

The second end of the piston is connected to a drive device for the piston, which moves the piston in a linear fashion in the cavity from the second position to the first position and vice versa. The drive device can be a camshaft of an engine, for example.

The pump housing of the plug-in pump has a cavity which forms at least one first chamber and one second chamber, which is separated from the first chamber. The first chamber is fluidically sealed off with respect to the second chamber.

The pump housing is connected to the cylinder and preferably surrounds part of the cylinder, in particular a cylindrical part of the cylinder, in which the cavity for the piston is at least partially formed. This part of the cylinder can project into the first cavity of the pump housing, for example. The housing and/or the cylinder can have a sealing element, which prevents the first fluid that enters the first chamber from escaping from the plug-in pump through the joint between the cylinder and the pump housing.

The first fluid can flow through the feed line in the pump housing into an annular passage, for example, formed in the pump housing. From the annular passage in the pump housing, the first fluid can flow through connecting passages, likewise formed in the pump housing, into a further annular passage, which is formed in the connecting region between the cylinder and the pump housing. Here, at least one side wall of said annular passage can be formed by an outer side of the cylinder and at least one other side wall can be formed by an outer side of the housing. For this purpose, a groove can be introduced into the cylinder and/or the pump housing, for example, in at least one of the facing ends of the cylinder and the pump housing, said groove becoming a closed passage through the connection of the cylinder to the pump housing.

From the annular passage formed in the connecting region of the cylinder and the pump housing, the fluid can flow in feed passages which carry the fluid to a supply chamber for the fluid in the region of the inlet valve for the pump working chamber. These feed passages can additionally be connected to return passages, which carry excess fluid back into a supply container.

The inlet valve is connected to an actuator, which controls the opening and closure of the inlet valve, which is preferably a digital inlet valve (DIV), according to specifiable criteria.

The second end of the piston can be connected to an intermediate piece, which transmits the movements of the drive unit to the piston. In this context, "can be connected" can mean that there are two separate parts, the mutually opposite end faces of which touch, abutting one another, or that the piston and the intermediate piece are formed integrally, or that the piston is connected by positive engagement and/or nonpositive engagement, for example, to the intermediate piece.

The intermediate piece is arranged in the cavity of the pump housing and extends from the first chamber into the second chamber. The intermediate piece can be a cylindrical body, for example, having a first section, which projects into the first chamber and rests by means of the end facing the cylinder on the second end of the piston, and a third section, which projects into or through the second chamber and makes direct or indirect contact with the drive device.

Between the first and the third section, the intermediate piece can have a second section, which connects the first section to the third section and projects through a connecting region, formed in the cavity of the pump housing, between the first chamber and the second chamber.

The connecting region can have the shape of a hollow cylinder, having an inside diameter which is preferably constant over the length thereof and corresponds substantially to an outside diameter of the second section. A sealing element can be fitted in the inner wall of the connecting region and/or on a surface of the outer circumference of the second section of the intermediate piece in order to separate the first chamber fluidically from the second chamber. The sealing element can be a simple scraper or can be a sealing ring, for example.

Respective spring elements can be arranged in the first chamber and/or in the second chamber of the cavity of the pump housing. The spring element or elements can be spiral springs, for example, which surround the intermediate piece or a part of the first section of the intermediate piece and/or a part of the third section of the intermediate piece. During the delivery stroke of the piston, the spring element or elements are subjected to a load by the drive device and, after the end of the delivery stroke, push the intermediate piece back in the opposite direction, i.e. bring about or assist the suction stroke of the piston when the latter follows the movement of the intermediate piece.

In the case of a spring element in the first chamber and another spring element in the second chamber, the spring forces of the two spring elements act in the same direction. This has the advantage that the individual spring element can be made smaller, which can lead to a smaller overall length and/or a smaller overall circumference of the pump housing.

The spring element in the first chamber can be supported on underside of the cylinder or an inner wall of the end of the cavity of the pump housing facing the cylinder and on the end of the intermediate piece facing the piston, for example. For this purpose, the intermediate piece can have a spring holder, i.e. an encircling widened portion, which is connected to the intermediate piece, being fitted onto the intermediate piece for example, or is partially formed by the intermediate piece, on which widened portion the end of the spring element remote from the cylinder can be supported.

The spring element in the second chamber can be supported on an underside of the connecting region and on a spring holder, which is connected to the end of the intermediate piece facing the drive device, for example.

The end of the pump housing facing the drive device can form a guide bushing for a drive slide, having a roller tappet which is moved by a cam of a camshaft. The drive slide can slide up and down in the guide bushing and thereby move the intermediate piece and impose a load on the spring elements. In this case, the spring holder for the spring element in the second chamber of the pump housing can be formed by the end of the intermediate piece facing the drive device, partially formed by the drive slide or connected to the latter.

As already mentioned, the drive device can be a camshaft of an internal combustion engine, wherein a cam of the camshaft preferably acts on a roller tappet, and the roller tappet converts a rotary motion of the camshaft into a linear motion of the intermediate piece and of the piston.

The first fluid is preferably a fuel for an internal combustion engine, e.g. gasoline or diesel or gas, and the second fluid is preferably a lubricating oil.

The cylinder can be formed from a high-grade steel, having a high strength, while the pump housing can be formed from cast steel or sintered steel, for example, having a lower strength than that of the cylinder. It is thereby possible to save on materials and processing costs and on weight. Moreover, the separate pump housing can be combined in a modular manner with cylinders for different combustibles, leading to further savings and, at the same time, to a desired standardization of components.

Throughout the description and the claims, the term "a" is not to be taken as restrictive. If this term is intended as a numerical indicator, this is made clear in the description and the claims by terms such as "a single". This means that the term "a" in this description can, but does not necessarily have to, be read as "at least one".

FIG. 1 shows a section through a plug-in pump 1 according to one embodiment. The plug-in pump 1 comprises or consists of a cylinder 2 and of a separate pump housing 3.

The cylinder 2 has a first part 2*b*, with a surface 2*a* which faces the pump housing. The first part 2*b* of the cylinder 2 has an inlet valve 7 with an actuator 9, which brings about opening and closure of the inlet valve 7, an outlet valve 8 and a pump working chamber 6. The pump working chamber 6 is part of a cavity 4.

The cylinder 2 furthermore has a second part 2*c*, which is formed jointly with the first part 2*b* and extends the first part 2*b* on an opposite side from the actuator 9. The second part 2*c* likewise has the cavity 4. The second part 2*c* has an outer circumference which is smaller than the outer circumference of the first part 2*b* and extends the first part 2*b* of the cylinder 2 in a central region.

In the second part 2*c*, the cavity 4 is a through hole, and in the first part 2*b* a blind hole which opens into the pump working chamber 6. Arranged in the cavity 4 is a piston 5, with a first end 5*a*, which has a shape that corresponds substantially to the shape of the pump working chamber 6, and a second end 5*b*, which projects beyond the end of the second part 2*c* of the cylinder 2. The piston 5 has an outer circumference which corresponds substantially to the inner circumference of the cavity 4. The piston 5 can move in a linear fashion in the cavity 4 into a first end position, in which it completely fills the pump working chamber 6, and into a second end position, in which the piston 5 is completely outside the pump working chamber 6. In the second end position, the piston 5 or the end 5*a* thereof facing the pump working chamber 6 forms a rear wall of the pump working chamber 6.

The plug-in pump 1 furthermore has a pump housing 3, having an end 3*a* facing the cylinder. The pump housing 3 has a cavity 10, which forms a first chamber 11, a second chamber 13 and a connecting region 15, which connects the first chamber 11 to the second chamber 13.

The pump housing 3 furthermore comprises a feed line 12 for a fuel and, at its end remote from the cylinder 2, a guide bushing 26 for a slide 27, which comprises a roller tappet, which is moved in a linear fashion in the guide bushing 26 by rotation of a cam 28 of a camshaft.

The second part 2*c* of the cylinder 2 projects into the first chamber 11. In order to seal off the engagement of the second part 2*c* of the cylinder 2 in the first chamber 11 of the pump housing 3, the cylinder 2 has an encircling engagement element 29 in the region of the transition of the first part 2*b* to the second part 2*c*, and the pump housing 3 has a sealing element 30 in the region of the contact of the engagement element 29 with an inner wall of the cavity 10 of the pump housing 3.

Arranged in the cavity 10 of the pump housing 3 is an intermediate piece 14, which connects the piston 5 to the drive device and the slide 27 to the roller tappet 28 and thus transmits the driving force of the drive device to the piston 5.

The intermediate piece 14 has a first section 14*a*, the end of which facing the cylinder 2 rests against the second end 5*b* of the piston 5 or is connected positively and/or non-positively thereto. Adjoining the first section 14*a* is a second section 14*b*, which projects through a connecting region 15 formed in the cavity 10. In the illustrative embodiment shown, the connecting region 15 is of hollow-cylindrical design, having an inside diameter which corresponds substantially to the outside diameter of the second section 14*b*, which is likewise of cylindrical design. The second section 14*b* has a sealing element 16 in the form of a scraper, which prevents a fluid situated in the first chamber 11 from being able to mix with a fluid present in the second chamber 13. This means that the connecting region 15 together with the second section 14*b* of the intermediate piece 14 seal off the first chamber 11 and the second chamber 13 fluidically from one another. Adjoining the second section 14*b* is a third section 14*c*, which is arranged in the second chamber 13 and is connected directly or indirectly to the roller tappet 28 or the slide 27.

Arranged in the first chamber 11 is a spring element 17, which is supported on the outer side 2*a* of the cylinder 2, said outer side facing the pump housing 3, and on a spring holder 19, which is fitted onto the end of the intermediate piece 14 facing the piston 5 in the illustrative embodiment shown. The spring element 17, which is a spiral spring that surrounds the second part 2*c* of the cylinder, is compressed during a movement of the piston 5 into the pump working chamber 6, a delivery stroke of the piston 5, and can expand again after the ending of the delivery stroke and, in the process, move and/or assist the piston 5 in a suction stroke movement. The second part 2*c* forms a guide for the spring element 17.

Arranged in the second chamber 13 is a spring element 18, which is supported on an underside of the intermediate region 15 and on a spring holder 21, wherein the spring holder 21 is connected to the slide 27 and/or to the end of the intermediate piece 14 facing the drive device. Spring element 18 is also compressed during the delivery stroke of the plug-in pump 1, and can then expand again and carry out and/or assist the suction stroke of the plug-in pump 1. As shown, the intermediate region 15 can be formed partially as a cylindrical sleeve which projects into the second chamber 13 and is surrounded by spring element 18, the sleeve thus forming a guide for spring element 18.

Figure 2:
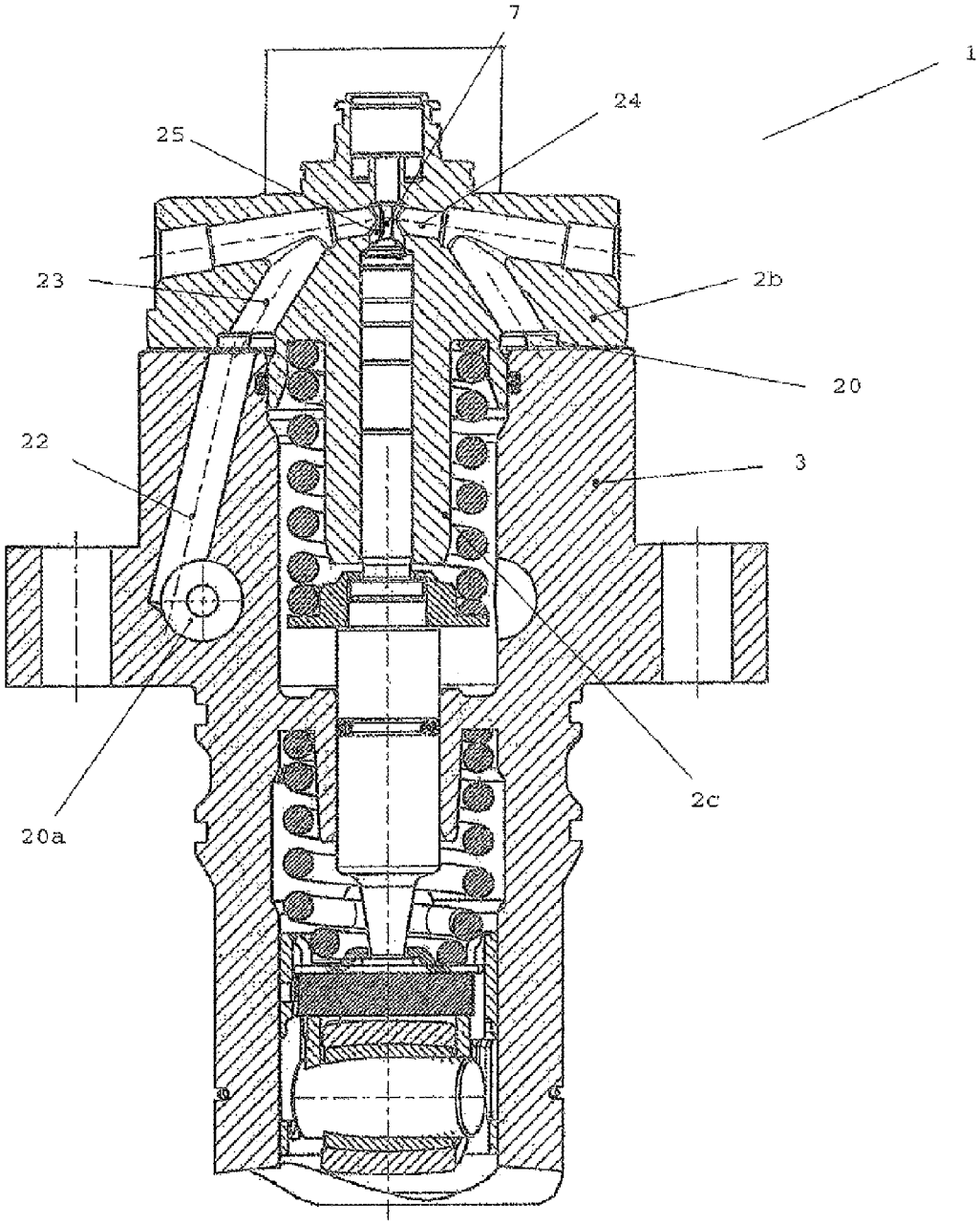
FIG. 2 shows another section through the plug-in pump in FIG. 1.

Another section through the plug-in pump 1 of FIG. 1 is shown in FIG. 2, showing a flow path of the fuel from the feed line (not visible in this view) to the inlet valve 7 by way of example. From the feed line 12, the fuel is carried into an annular passage 20*a*, which is formed in the pump housing 3 and extends in the pump housing 3 around the cavity 10 at the level of the feed line 12. From the annular passage 20*a*, the fuel is carried via feed passages 22 into the annular passage 20 formed between the cylinder 2 and the pump housing 3. Connecting passages 23 lead from the annular passage 20 to delivery passages 24, which carry the fuel into a fuel supply chamber 25 situated ahead of the inlet valve 7. The delivery passages 24 are connected to return passages, which carry fuel that is not needed back into a tank.

LIST OF REFERENCE SIGNS 1 plug-in pump
2 cylinder
2*a* end of cylinder
2*b* first part of cylinder
2*c* second part of cylinder
3 pump housing
3*a* end of pump housing
4 cavity of cylinder
5 piston
5*a* first end of piston
5*b* second end of piston
6 pump working chamber
7 inlet valve
8 outlet valve
8*a* outlet
9 actuator
10 cavity of pump housing
11 first chamber
12 fuel feed line
13 second chamber
14 intermediate piece
14*a* first section
14*b* second section
14*c* third section
15 connecting region
16 sealing element
17 spring element
18 spring element
19 spring holder
20 annular passage
20*a* annular passage
21 spring holder
22 feed passage
23 connecting passage
24 delivery passage
25 fuel supply chamber
26 guide bushing
27 slide
28 roller tappet
29 engagement element
30 sealing element

The invention claimed is:

1. A plug-in pump comprising:

a pump housing defining a cylinder cavity, a movable piston arranged in the cylinder cavity, wherein a first end of the piston delimits a pump chamber within the cavity, and a second end of the piston is connected through an intermediate piece to a slide comprising a roller tappet moving along a shared axis with the movable piston within a guide bushing, the roller tappet riding along a drive device for the piston, an inlet valve arranged in the pump housing, wherein the inlet valve connects the pump chamber to a feed line for a first fluid, and an outlet valve that connects the pump chamber to an outlet, wherein the cylinder cavity includes (a) a first chamber surrounding the second end of the piston and a first portion of the intermediate piece, the first chamber fluidly connected to a fluid system of the first fluid, and (b) at least one second chamber surrounding a exterior perimeter of a second portion of the intermediate piece and sealed off from the first chamber and connected to a fluid system of a second fluid, wherein the intermediate piece extends from the first chamber to the second chamber through a sealing element separating the first chamber from the second chamber.

2. The plug-in pump of claim 1, wherein the second end of the piston is connected to or formed integrally with the intermediate piece that transmits a movement of the drive device to the piston.

3. The plug-in pump of claim 2, wherein the intermediate piece includes a first section that projects into the first chamber, a third section that projects into the second chamber, and a second section that connects the first section and the third section and projects through a connecting region formed in the cavity between the first chamber and the second chamber.

4. The plug-in pump of claim 3, wherein:

the connecting region has a shape of a hollow cylinder having an inside diameter that corresponds substantially to an outside diameter of the second section, and at least one of the inner wall of the connecting region and the second section has a sealing element that prevents the first and second fluids from mixing with each other.

5. The plug-in pump of claim 1, comprising at least one spring element arranged in at least one of the first chamber and the second chamber, wherein the at least one spring element moves the piston and the intermediate piece in a direction in which the inlet valve connects the feed line to the pump chamber.

6. The plug-in pump of claim 1, comprising a spring element in the first chamber, wherein the spring element moves the piston and the intermediate piece in a direction in which the inlet valve connects the feed line to the pump chamber, and wherein the spring element is supported on an underside of the cylinder head and on a spring holder connected to an end of the intermediate piece facing the second end of the piston.

7. The plug-in pump of claim 1, comprising a spring element in the second chamber, wherein the spring element moves the piston and the intermediate piece in a direction in which the inlet valve connects the feed line to the pump chamber, and wherein the spring element is supported on an underside of the connecting region and on a spring holder connected to an end of the intermediate piece facing the drive device.

8. The plug-in pump of claim 1, wherein:

the first fluid is carried by the feed line and a connecting line in the pump housing into an annular passage, the annular passage is formed in a connecting region between the cylinder and the housing, and at least one side wall of the annular passage is formed by an outer side of the cylinder and at least one side wall of the annular passage is formed by an outer side of the housing.

9. The plug-in pump of claim 1, wherein:

the drive device is a camshaft, and a cam of the camshaft acts on the roller tappet to convert a rotary motion of the camshaft into a linear motion of the piston.

10. The plug-in pump of claim 1, wherein the inlet valve is a digital inlet valve.

11. The plug-in pump of claim 1, wherein the first fluid is a fuel and the second fluid is a lubricating oil.

12. The plug-in pump of claim 1, wherein the cylinder is formed from steel and the pump housing is formed from cast steel or sintered steel.

13. A fuel injection system, comprising:

a plug-in pump comprising:

a pump housing defining a cylinder cavity, a movable piston arranged in the cylinder cavity, wherein a first end of the piston delimits a pump chamber within the cavity, and a second end of the piston is connected through an intermediate piece to a slide comprising a roller tappet moving along a shared axis with the movable piston within a guide bushing, the roller tappet riding along a drive device for the piston, an inlet valve arranged in the pump housing, wherein the inlet valve connects the pump chamber to a feed line for a first fluid, and an outlet valve that connects the pump chamber to an outlet, wherein the cylinder cavity includes (a) a first chamber surrounding the second end of the piston and a first portion of the intermediate piece, the first chamber fluidly connected to a fluid system of the first fluid, and (b) at least one second chamber surrounding a exterior perimeter of a second portion of the intermediate piece and sealed off from the first chamber and connected to a fluid system of a second fluid, wherein the intermediate piece extends from the first chamber to the second chamber through a sealing element separating the first chamber from the second chamber.

14. The fuel injection system of claim 13, wherein the second end of the piston of the plug-in pump is connected to or formed integrally with the intermediate piece that transmits a movement of the drive device to the piston.

15. The fuel injection system of claim 14, wherein the intermediate piece includes a first section that projects into the first chamber, a third section that projects into the second chamber, and a second section that connects the first section and the third section and projects through a connecting region formed in the cavity between the first chamber and the second chamber.

16. The fuel injection system of claim 15, wherein:

the connecting region has a shape of a hollow cylinder having an inside diameter that corresponds substantially to an outside diameter of the second section, and at least one of the inner wall of the connecting region and the second section has a sealing element that prevents the first and second fluids from mixing with each other.

17. The fuel injection system of claim 13, wherein the plug-in pump comprises at least one spring element arranged in at least one of the first chamber and the second chamber, wherein the at least one spring element moves the piston and the intermediate piece in a direction in which the inlet valve connects the feed line to the pump chamber.

18. The fuel injection system of claim 13, wherein the plug-in pump comprises a spring element in the first chamber, wherein the spring element moves the piston and the intermediate piece in a direction in which the inlet valve connects the feed line to the pump chamber, and wherein the spring element is supported on an underside of the cylinder head and on a spring holder connected to an end of the intermediate piece facing the second end of the piston.

19. The fuel injection system of claim 13, wherein the plug-in pump comprises a spring element in the second chamber, wherein the spring element moves the piston and the intermediate piece in a direction in which the inlet valve connects the feed line to the pump chamber, and wherein the spring element is supported on an underside of the connecting region and on a spring holder connected to an end of the intermediate piece facing the drive device.

20. The fuel injection system of claim 13, wherein:

the first fluid is carried by the feed line and a connecting line in the pump housing into an annular passage, the annular passage is formed in a connecting region between the cylinder and the housing, and at least one side wall of the annular passage is formed by an outer side of the cylinder and at least one side wall of the annular passage is formed by an outer side of the housing.

* * * * *